US006343584B1

(12) United States Patent
Kudou et al.

(10) Patent No.: US 6,343,584 B1
(45) Date of Patent: Feb. 5, 2002

(54) LUBRICATION STRUCTURE FOR 4-CYCLE ENGINE

(75) Inventors: Osamu Kudou; Nobuaki Inumaru; Satoshi Shimashita; Kouichi Tsutsumi; Yoshimi Yamaguchi; Hiroshi Yamaura, all of Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/539,714

(22) Filed: Mar. 31, 2000

(30) Foreign Application Priority Data

Mar. 31, 1999 (JP) ..... 11-092659

(51) Int. Cl.[7] ..... F01M 1/02
(52) U.S. Cl. ..... 123/196 R
(58) Field of Search ..... 123/196 R, 196 M, 123/196 CP, 192.2; 184/6.5, 6.8

(56) References Cited

U.S. PATENT DOCUMENTS 5,467,843 A * 11/1995 Esch et al. ..... 123/196 R
6,202,621 B1 * 3/2001 Inumaru et al. ..... 123/196 R

FOREIGN PATENT DOCUMENTS

| | | | |
|---|---|---|---|
| JP | A625527 | | 4/1994 |
| JP | 200087714 A | * | 3/2000 |
| JP | 2000283271 A | * | 10/2000 |

* cited by examiner

*Primary Examiner*—Henry C. Yuen
*Assistant Examiner*—Hyder Ali

(57) ABSTRACT

A lubrication system for an engine includes an oil discharge port in a lower section of a crankcase. A crankshaft, with a crank web attached thereto, rotates in a rotation direction within the crankcase. A first distance is formed between the crank web and a first inner surface of the crankcase, downstream of the oil discharge port. A second distance is formed between the crank web and a second inner surface of the crankcase, upstream of the oil discharge port. The first distance is less than the second distance. Also, the oil discharge port is defined in part by a back edge, which is wedge shaped and points in a direction opposite the rotation direction of the crankshaft. The back edge scoops oil from the crank web and into the oil discharge port.

17 Claims, 3 Drawing Sheets

LUBRICATION STRUCTURE FOR 4-CYCLE ENGINE

BACKGROUND OF THE INVENTION

1. Field of the Invention

The present invention relates to a lubrication structure for an engine, such as a four-cycle engine.

2. Description of the Relevant Art

A lubrication system for an engine, such as a four-cycle engine, is disclosed in the background art. For example, Japanese Patent Publication No. Hei. 6-25527 discloses a lubrication system. In the background art, a crank web is provided in the crankcase. A distance between a lower inner surface of the crankcase and an outer periphery of the crank web is set almost uniformly around the peripheral direction of the crank case. This structuring of the background art makes it relatively difficult to discharge oil from an oil discharge port.

SUMMARY OF THE INVENTION

It is an object of the present invention to solve one or more of the drawbacks associated with the background art.

It is a further object of the present invention to provide a lubrication system with improved oil discharge performance from a crank chamber.

These and other objects are fulfilled by an engine comprising: a crankcase; a crank chamber formed inside said crankcase; a crankshaft housed inside said crank chamber, said crankshaft rotating in a rotation direction; a crank web attached to said crankshaft; an oil discharge port formed in a lower section of said crank chamber; a first distance formed between an outer periphery of said crank web and a first inner surface of said crankcase, said first inner surface being downstream of said oil discharge port in said rotation direction; and a second distance formed between said outer periphery of said crank web and a second inner surface of said crankcase, said second inner surface being upstream of said oil discharge port in said rotation direction, wherein said first distance is less than said second distance.

Moreover, these and other objects are fulfilled by an engine comprising: a crankcase; a crank chamber formed inside said crankcase; a crankshaft housed inside said crank chamber, said crankshaft rotating in a rotation direction; a crank web attached to said crankshaft; an oil discharge port formed in a lower section of said crank chamber, said oil discharge port being defined in part by a back edge, wherein said back edge is wedge shaped and points in a direction opposite said rotation direction, at least at a section corresponding to said crank web.

Other objects and further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DETAILED DESCRIPTION OF THE INVENTION

Figure 1:
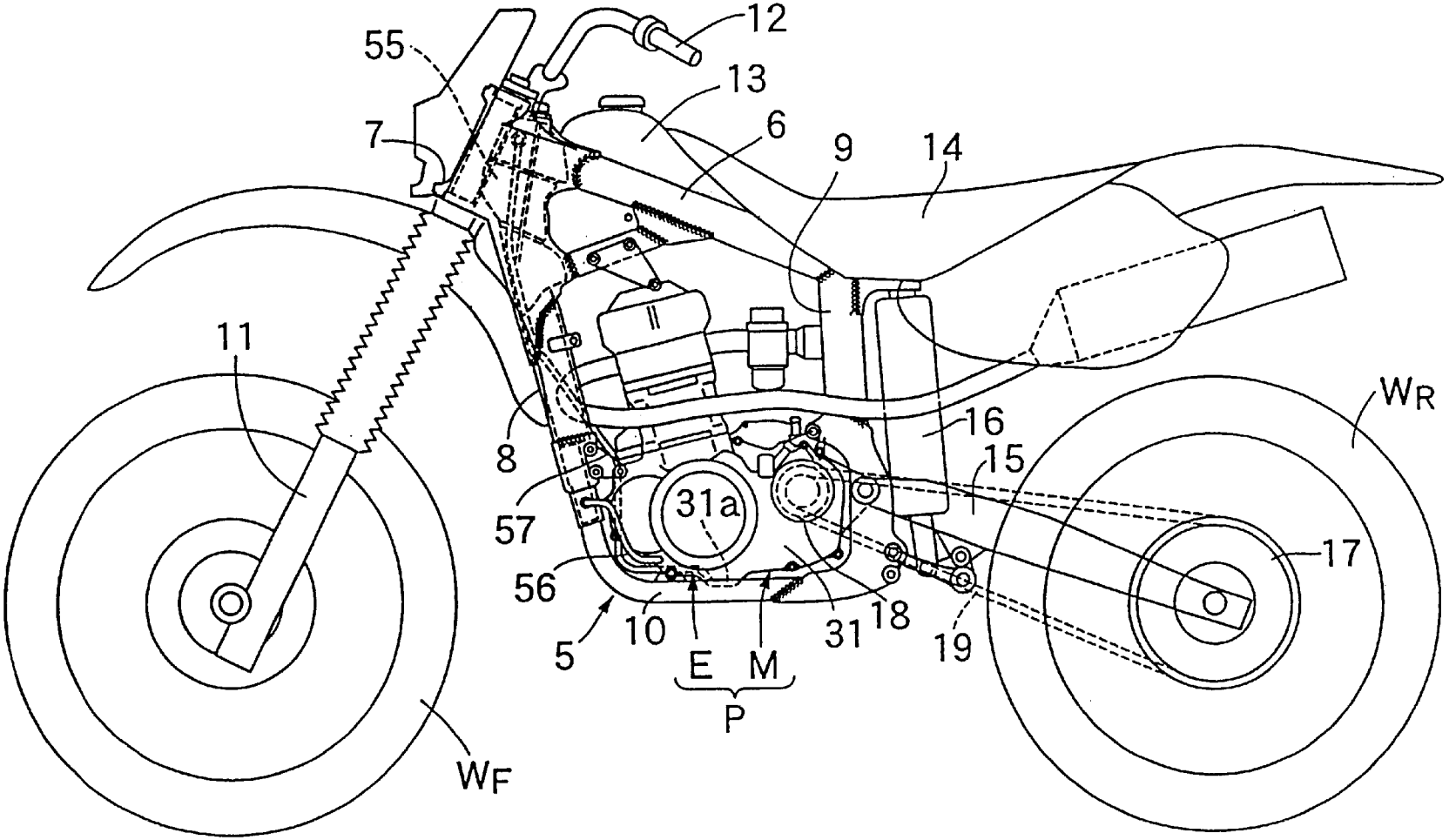
FIG. 1 is a side view of a motorcycle including a lubrication system in accordance with the present invention.

In FIG. 1, a vehicle frame 5 of a motorcycle is formed in a cradle shape. The vehicle frame 5 includes a main pipe 6 angled slightly downwards and extending in a longitudinal direction; a head pipe 7 provided at a front end of the main pipe 6; a down pipe 8 extending rearwards and downwards from the head pipe 7; a center pipe 9 extending downwards from a rear end of the main pipe 6; and a pair of left and right lower pipes 10. The left and right lower pipes 10 link between a lower end of the down pipe 8 and a lower end of the center pipe 9.

A front fork 11 is supported by the head pipe 7 so that it can be steered. A front wheel $W_R$ is axially supported at a lower end of the front fork 11. A steering handlebar 12 is connected to an upper end of the front fork 11. A fuel tank 13 and a seat 14 are provided on the vehicle frame 5. A power unit P, including a single cylinder 4-cycle engine E and a transmission M, is mounted in the vehicle frame 5 below the fuel tank 13 and the seat 14.

A front end of a rear swingarm 15 is supported at a rear section of the vehicle frame so as to be capable of swinging up and down. A rear wheel $W_R$ is axially supported at a rear end of the rear swingarm 15. A rear shock absorber is provided between of the rear swingarm 15 and a rear end section of the vehicle frame 5. An endless chain 19 is looped around a driven sprocket 17 provided coaxially with the rear wheel $W_R$. A drive sprocket 18 is provided on the power unit P. The rear wheel $W_R$ is driven by rotational power exerted by the power unit P.

Figure 2:
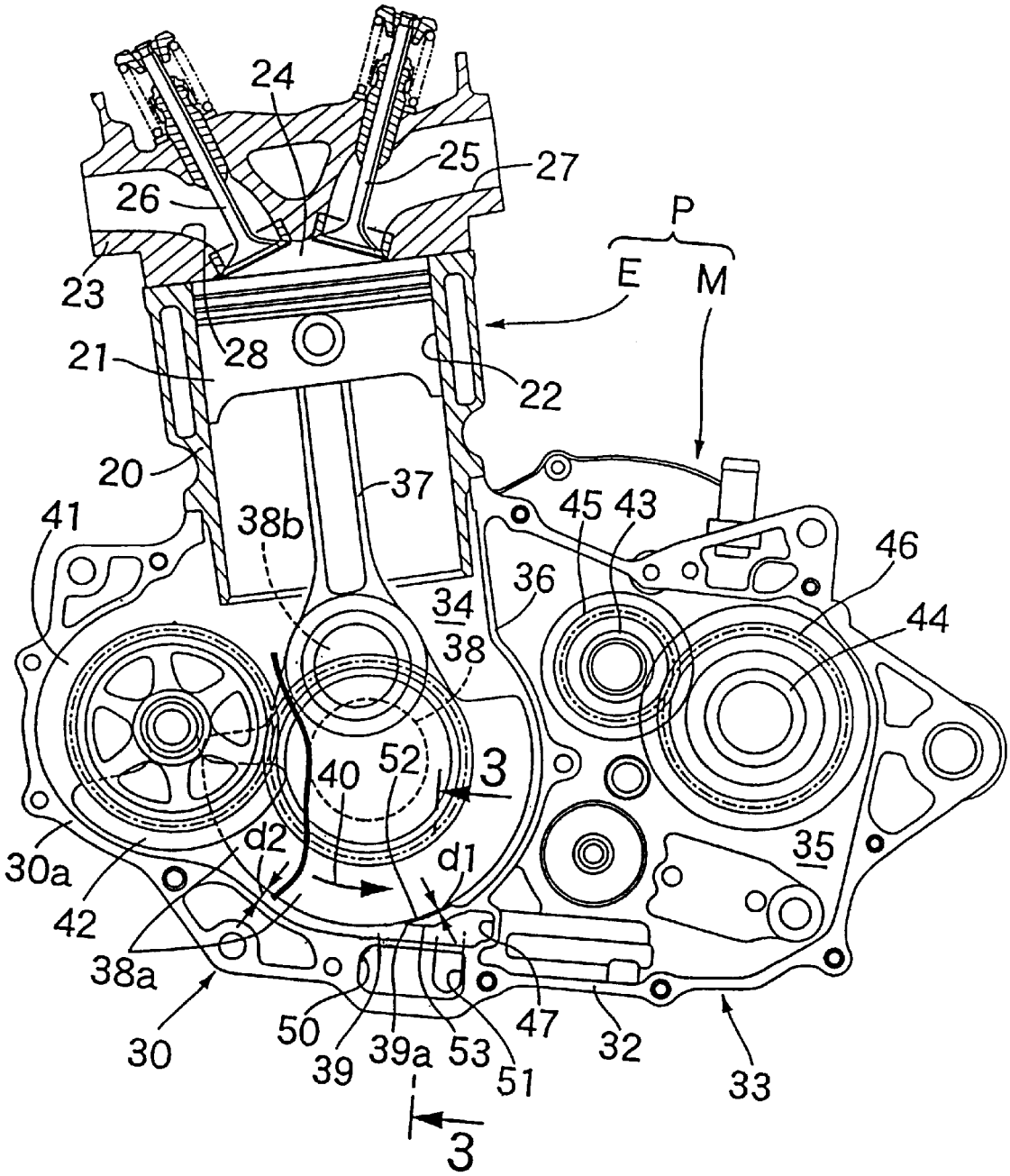
FIG. 2 is a cross sectional view of a power unit of the motorcycle of FIG. 1, taken along line 2—2 in FIG. 3.

In FIG. 2, a cylinder bore 22 is provided in a cylinder block 20 of the engine E. A piston 21 reciprocates inside the cylinder bore 22. A combustion chamber 24 is formed between a cylinder head 23 joined to the cylinder block 20 and a crown of the piston 21. An intake port 27 and an exhaust port 28 are provided in the cylinder head 23. An intake valve 25 opens and closes the intake port 27 relative to the combustion chamber 24. Likewise, an exhaust valve 26 opens and closes the exhaust port 28 relative to the combustion chamber 24.

Figure 3:
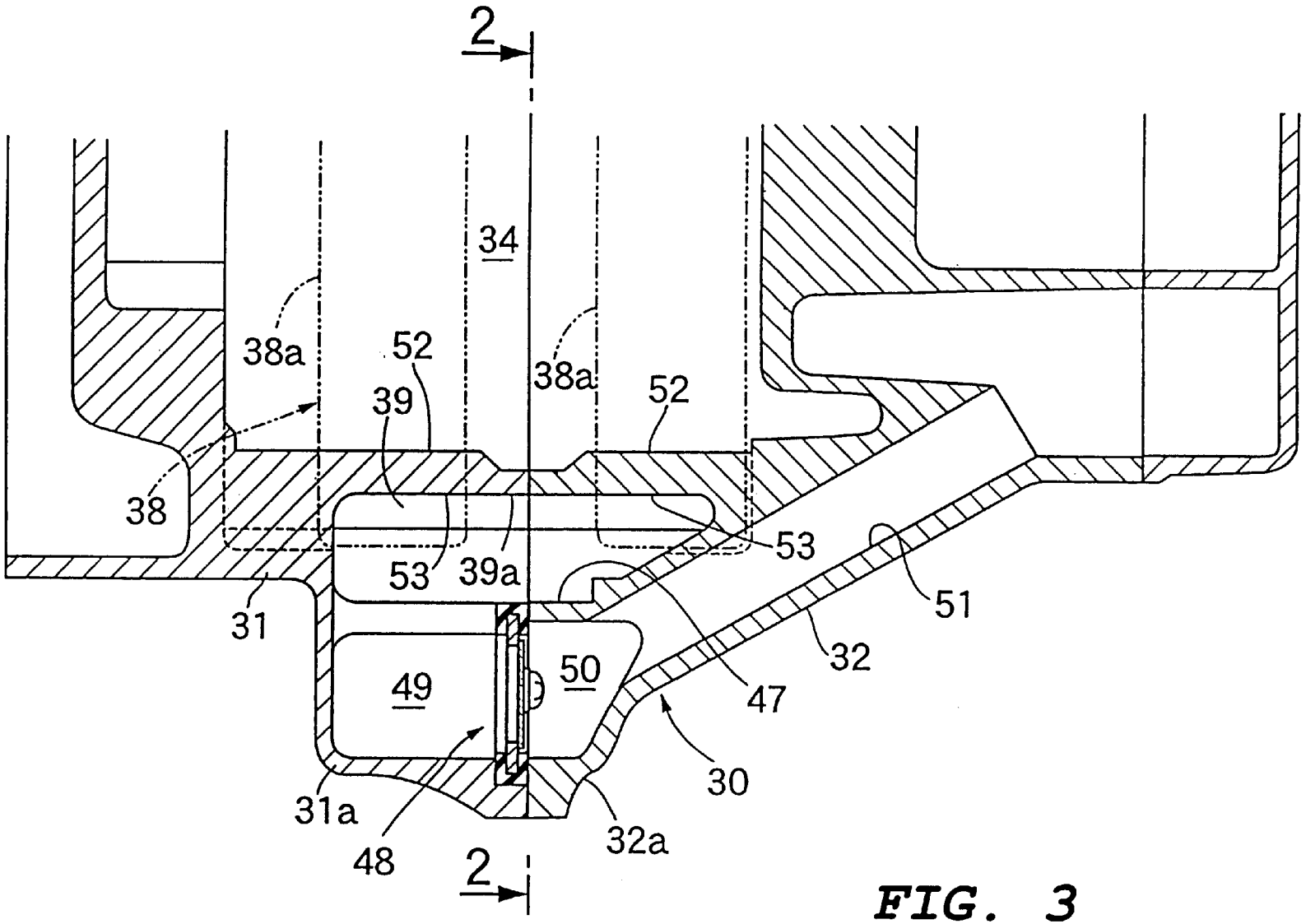
FIG. 3 is a cross sectional view taken along line 3—3 in FIG. 2.

With reference to FIG. 3, a crankcase 30 is joined to the cylinder block 20. The crankcase 30 is made up of a pair of left and right engine cases 31 and 32. A crank chamber 34 is formed inside the crankcase 30.

A transmission case 33 of the transmission M is also formed by the left and right engine cases 31 and 32. A separating wall 36 separates the inside of the left and right engine cases 31 and 32 into the crank chamber 34 and a transmission chamber 35.

A pair of crank webs 38*a*, 38*a*, and a crank pin 38*b* connecting between the two crank webs 38*a*, 38*a*, are provided inside the crank chamber 34. The piston 21 is connected to the crank pin 38*b* of the crankshaft 38 via a connecting rod 37. The two end sections of the crankshaft 38 are rotatably supported by the left and right engine cases 31 and 32.

An oil discharge port 39 is provided in a bottom section of the crankcase 30. The oil discharge port 39 opens to a bottom section of the crank chamber 34. A bulging section 30*a* is provided in the crankcase 30. The bulging section 30*a* bulges outwardly and forwardly (with the engine E mounted on the vehicle frame). The bulging section 30*a* is on an upstream side of the oil discharge port 39, taken in the rotation direction 40 of the crankshaft 38.

A balancer chamber 41, opening to the inside of the crank chamber 34, is formed inside the bulging section 30*a*. A balancer 42 is housed in the balancer chamber 41. The balancer 42 rotates around an axis parallel to the crankshaft 38. The balancer 42 rotates in synchronism with the crankshaft 38.

A main shaft 43 and a counter shaft 44 are rotatably supported by the left and right engine cases 31 and 32, in the transmission M side. The main shaft 43 and the counter shaft 44 are parallel to the crankshaft 38. The drive sprocket 18 is fixed to an end of the counter shaft 44 projecting from the left engine case 31.

A plurality of transmission gears 45 are fitted onto the main shaft 43. Also, a plurality of transmission gears 46, corresponding to each of the plurality of transmission gears 45, are fitted onto the counter shaft 44. An output of the engine E is shifted through a plurality of stages and conveyed to the counter shaft 44 by selective setting of the pluralities of transmission gears 45 and 46.

An oil sump 47 opening to the oil discharge port 39 is provided in a bottom section of the crankcase 30. The oil sump 47 is formed by a pouch type hole opposite the rotation direction 40 of the crankshaft 38. A reed valve 48 allows oil to flow from the crank chamber 34 to the transmission chamber 35. The reed valve 48 is fitted as a unidirectional valve into a bottom section of the crankcase 30, lower down than the oil sump 47.

Bottom sections of the left and right engine cases 31 and 32 are shaped with swollen sections 31*a* and 32*a* facing downwardly. The swollen sections 31*a* and 32*a* together form a valve chamber. The reed valve 48 is situated between the swollen sections 31*a* and 32*a*. An inlet side valve chamber 49, communicating with the oil discharge port 39 and the oil sump 47, is formed between the reed valve 48 and the swollen section 31*a* of the left engine case 31. An outlet side valve chamber 50 is formed between the reed valve 48 and the swollen section 32*a* of the right engine case 32. An oil path 51 is provided in the right engine case 32, and connects to the outlet side valve chamber 50. The oil path 51 leads oil, discharged from the crank chamber 34 via the reed valve 48, into the transmission chamber 35.

An opening edge 39*a* defines the downstream or back edge of the oil discharge port 39. The opening edge 39*a* includes sections respectively corresponding to each of the crank webs 38*a*, 38*a*, which sections extend in a direction parallel to the crankshaft 38. The sections are formed in a wedge shape, like a knife's edges pointing in a direction opposite to the rotation direction 40 of the crankshaft 38. Each knife edge has a curved surface 52 as an upper wall and a flat surface 53 as a bottom wall. The knife edges act to scoop oil away from an adjacent crank web 38*a* and into the oil discharge port 39. Each curved surface 52 follows an outer periphery of the adjacent crank web 38*a*. Each flat surface 53 extends in a direction tangential to the adjacent crank web 38*a*.

A first distance d1 is defined between a first lower inner surface of the crankcase 30 and the outer periphery of the crank webs 38*a*, 38*a*, with the first distance d1 running in the rotation direction 40 of the crankshaft 38, and extending from the oil discharge port 39 over a fixed range on the downstream side of the oil discharge port 39. More specifically, the first distance d1 resides between the curved surfaces 52, 52, on the downstream side of the opening edges 39*a*, 39*a*, and the outer peripheries of the crank webs 38*a*, 38*a*.

A second distance d2 is defined between a second lower inner surface of the crankcase 30 and the outer periphery of the crank webs 38*a*, 38*a*, with the second distance d2 running in the rotation direction 40 of the crankshaft 38, and extending over a fixed range upstream, before the oil discharge port 39. The first distance d1 is set less than, e.g. narrower than, the second distance d2.

Referring once again to FIG. 1, swollen sections 31*a* and 32*a* of the bottom parts of the left and right engine cases 31 and 32 are swollen sections on the outer periphery of the crankcase 30, which are arranged between the two lower pipes 10 of the vehicle frame 5. Because the swollen sections 31*a* and 32*a* do not extend below the two lower pipes 10, there is no additional restriction on the ground clearance of the motorcycle. Further, the presence of the swollen sections 31*a*, 32*a* does not reduce the ease in mounting the power unit P on the vehicle frame 5.

An oil tank 55 is provided in a section of the vehicle frame 5 where the main pipe 6, head pipe 7 and down pipe 8 join up. Oil, drawn up from the transmission chamber 35 by a first oil pump (not shown), is returned to an upper section of the oil tank 55 by a return pipe 56. Oil, drawn from a lower section of the oil tank 55 by a second pump (not shown), is supplied through a supply pipe 57 to parts of the power unit P to be lubricated. The first oil pump and the second oil pump may be included within the power unit P.

Next, the operation of the present invention will be described. Pressure inside the crank chamber 34 is varied by reciprocation of the piston 21 inside the cylinder bore 22. When the pressure inside the crank chamber 34 is increased, oil inside the crank chamber 34 is discharged to the transmission chamber 35 by opening the reed valve 48.

Since the second distance d2, upstream from the oil discharge port 39, is comparatively large, oil follows the outer periphery of the crank webs 38*a* and 38*a* as the crankshaft 38 rotates. The oil that follows the crank webs 38*a* and 38*a* encounters the oil discharge port 39. The knife edge shape of the opening edge 39*a* assists in scooping oil from the periphery of the crank webs 38*a* and 38*a* into the oil discharge port 39.

Also, since the distance d1, downstream from the oil discharge port 39, is comparatively small, the amount of oil passing the oil discharge port 39, and hence following the crank webs 38*a* and 38*a* past the oil discharge port 39 is restricted. In other words, the amount of oil following the crank webs 38*a* and 38*a* along the section defined by the second distance d2 is greater than the amount of oil following the crank webs 38*a* and 38*a* along the section defined by the first distance d1.

Accordingly, it is possible to favorably return oil to the oil discharge port 39, and the performance of discharging oil from the crank chamber 34 is improved. Improved discharging of oil from the crank chamber 34 leads to an improvement in the engine's output due to a reduced rotational friction on the engine E.

Because the balancer chamber 41 communicates to the inside of the crank chamber 34, oil is also effectively discharged from the balancer chamber 41. Therefore, rotational friction of the balancer 42 is also reduced. This leads to a further improvement in the output of the engine E.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An engine comprising:

a crankcase;

a crank chamber formed inside said crankcase;

a crankshaft housed inside said crank chamber, said crankshaft rotating in a rotation direction;

a crank web attached to said crankshaft;

an oil discharge port formed in a lower section of said crank chamber;

a first distance formed between an outer periphery of said crank web and a first inner surface of said crankcase, said first inner surface being downstream of said oil discharge port in said rotation direction;

a second distance formed between said outer periphery of said crank web and a second inner surface of said crankcase, said second inner surface being upstream of said oil discharge port in said rotation direction, wherein said first distance is less than said second distance; and a balancer chamber formed in said crankcase, said balancer chamber being in fluid communication with said crank chamber.

2. The engine according to claim 1, further comprising:

a balancer housed inside said balancer chamber, said balancer rotating about a balancer axis which is parallel to a crankshaft axis about which said crankshaft rotates.

3. The engine according to claim 1, wherein said balancer chamber is a bulging section in a forward outer periphery of said crankcase.

4. The engine according to claim 1, wherein said balancer chamber is downstream of said first inner surface of said crankcase and upstream of said second inner surface of said crankcase, in said rotation direction of said crankshaft.

5. The engine according to claim 1, wherein said balancer chamber is downstream of said first inner surface of said crankcase and upstream of said oil discharge port, in said rotation direction of said crankshaft.

6. An engine comprising:

a crankcase;

a crank chamber formed inside said crankcase;

a crankshaft housed inside said crank chamber, said crankshaft rotating in a rotation direction;

a crank web attached to said crankshaft;

an oil discharge port formed in a lower section of said crank chamber;

a first distance formed between an outer periphery of said crank web and a first inner surface of said crankcase, said first inner surface being downstream of said oil discharge port in said rotation direction;

a second distance formed between said outer periphery of said crank web and a second inner surface of said crankcase, said second inner surface being upstream of said oil discharge port in said rotation direction, wherein said first distance is less than said second distance; and a valve chamber in fluid communication with said oil discharge port, wherein said valve chamber is a swollen section formed on a lower outer periphery of said crankcase.

7. An engine comprising:

a crankcase;

a crank chamber formed inside said crankcase;

a crankshaft housed inside said crank chamber, said crankshaft rotating in a rotation direction;

a crank web attached to said crankshaft;

an oil discharge port formed in a lower section of said crank chamber;

a first distance formed between an outer periphery of said crank web and a first inner surface of said crankcase, said first inner surface being downstream of said oil discharge port in said rotation direction;

a second distance formed between said outer periphery of said crank web and a second inner surface of said crankcase, said second inner surface being upstream of said oil discharge port in said rotation direction, wherein said first distance is less than said second distance;

a valve chamber in fluid communication with said oil discharge port; and a reed valve disposed in said valve chamber and dividing said valve chamber into a inlet side and an outlet side.

8. The engine according to claim 7, further comprising:

an oil path for communicating said outlet side to a transmission chamber.

9. An engine comprising:

a crankcase;

a crank chamber formed inside said crankcase;

a crankshaft housed inside said crank chamber, said crankshaft rotating in a rotation direction;

a crank web attached to said crankshaft; and an oil discharge port formed in a lower section of said crank chamber, said oil discharge port being defined in part by a back edge, wherein said back edge is wedge shaped and points in a direction opposite said rotation direction, at least at a section corresponding to said crank web, wherein said back edge is formed by an intersection of an upper wall and a bottom wall, with said upper wall being curved and following an outer periphery of said crank web.

10. The engine according to claim 9, wherein said lower wall is generally flat and resides in a plane tangential to an outer periphery of said crank web.

11. An engine comprising:

a crankcase;

a crank chamber formed inside said crankcase;

a crankshaft housed inside said crank chamber, said crankshaft rotating in a rotation direction;

a crank web attached to said crankshaft;

an oil discharge port formed in a lower section of said crank chamber, said oil discharge port being defined in part by a back edge, wherein said back edge is wedge shaped and points in a direction opposite said rotation direction, at least at a section corresponding to said crank web;

a first distance formed between an outer periphery of said crank web and a first inner surface of said crankcase, said first inner surface being downstream of said back edge of said oil discharge port in said rotation direction; and a second distance formed between an outer periphery of said crank web and a second inner surface of said crankcase, said second inner surface being upstream of said oil discharge port in said rotation direction, wherein said first distance is less than said second distance.

12. The engine according to claim 11, further comprising:

a balancer chamber formed in said crankcase, said balancer chamber being in fluid communication with said crank chamber, wherein said balancer chamber is downstream of said first inner surface of said crankcase and upstream of said second inner surface of said crankcase, in said rotation direction of said crankshaft.

13. The engine according to claim 11, further comprising:

a balancer chamber formed in said crankcase, said balancer chamber being in fluid communication with said crank chamber, wherein said balancer chamber is downstream of said first inner surface of said crankcase and upstream of said oil discharge port, in said rotation direction of said crankshaft.

14. An engine comprising:

a crankcase;

a crank chamber formed inside said crankcase;

a crankshaft housed inside said crank chamber, said crankshaft rotating in a rotation direction;

a crank web attached to said crankshaft;

an oil discharge port formed in a lower section of said crank chamber, said oil discharge port being defined in part by a back edge, wherein said back edge is wedge shaped and points in a direction opposite said rotation direction, at least at a section corresponding to said crank web; and a balancer chamber formed in said crankcase, said balancer chamber being in fluid communication with said crank chamber.

15. The engine according to claim 14, further comprising:

a balancer housed inside said balancer chamber, said balancer rotating about a balancer axis which is parallel to a crankshaft axis about which said crankshaft rotates.

16. The engine according to claim 14, wherein said balancer chamber is a bulging section in a forward outer periphery of said crankcase.

17. An engine comprising:

a crankcase;

a crank chamber formed inside said crankcase;

a crankshaft housed inside said crank chamber, said crankshaft rotating in a rotation direction;

a crank web attached to said crankshaft;

an oil discharge port formed in a lower section of said crank chamber, said oil discharge port being defined in part by a back edge, wherein said back edge is wedge shaped and points in a direction opposite said rotation direction, at least at a section corresponding to said crank web;

a valve chamber in fluid communication with said oil discharge port;

a reed valve disposed in said valve chamber and dividing said valve chamber into a inlet side and an outlet side; and an oil path for communicating said outlet side to a transmission chamber.

* * * * *